US006805603B2

(12) United States Patent
Kawamura et al.

(10) Patent No.: US 6,805,603 B2
(45) Date of Patent: Oct. 19, 2004

(54) ELECTRODE, MANUFACTURING METHOD THEREOF, AND METAL VAPOR DISCHARGE LAMP

(75) Inventors: Tatsuya Kawamura, Takarazuka (JP); Toshizo Kobayashi, Higashiosaka (JP); Hiroshi Enami, Nishinomiya (JP); Yoshiharu Nishiura, Otsu (JP); Takaharu Yanata, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 107 days.

(21) Appl. No.: 10/213,133

(22) Filed: Aug. 5, 2002

(65) Prior Publication Data

US 2003/0030373 A1 Feb. 13, 2003

(30) Foreign Application Priority Data

Aug. 9, 2001 (JP) ..... 2001-242601
Oct. 25, 2001 (JP) ..... 2001-328266

(51) Int. Cl.[7] ..... H01J 9/02; H01J 9/00
(52) U.S. Cl. ..... 445/46; 445/35
(58) Field of Search ..... 445/46, 48, 49, 445/51, 35, 7; 140/71.5, 71.6; 313/631, 638, 491, 141

(56) References Cited

U.S. PATENT DOCUMENTS 5,320,569 A 6/1994 Oshima et al.
5,440,198 A 8/1995 Oshima et al.
5,484,315 A * 1/1996 Juengst et al. ..... 445/26
6,404,130 B1 6/2002 Dinter
6,533,628 B1 * 3/2003 Matsutani ..... 445/7

FOREIGN PATENT DOCUMENTS

| | | |
|---|---|---|
| JP | 6-36856 | 2/1994 |
| JP | 6-45050 | 2/1994 |
| JP | 9-213273 | 8/1997 |
| JP | 2000-231879 | 8/2000 |
| JP | 2000-251842 | 9/2000 |

* cited by examiner

*Primary Examiner*—Vip Patel
*Assistant Examiner*—Glenn D. Zimmerman
(74) *Attorney, Agent, or Firm*—Merchant & Gould P.C.

(57) ABSTRACT

A first electrode part in a rod shape is placed on an upper side, and a second electrode part in a rod shape having a higher melting point than that of the first electrode part is placed on a lower side, so that ends of the first and second electrode parts are brought into contact. Contact ends or vicinities thereof are irradiated with a laser beam, so that the electrode parts are welded. Here, a region irradiated with the laser beam is in a long narrow shape having a minor axis directed in a vertical direction and a major axis directed in a horizontal direction. This makes it possible to manufacture an electrode with a consistent high quality with a high yield.

14 Claims, 8 Drawing Sheets

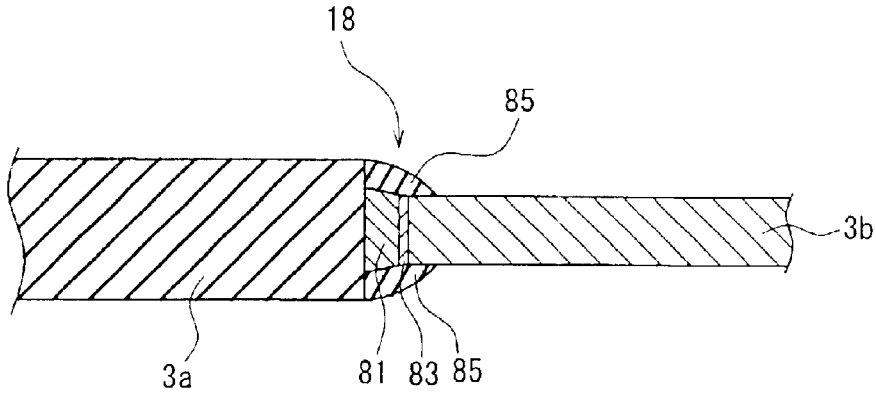
FIG. 4
FIG. 5A
PRIOR ART
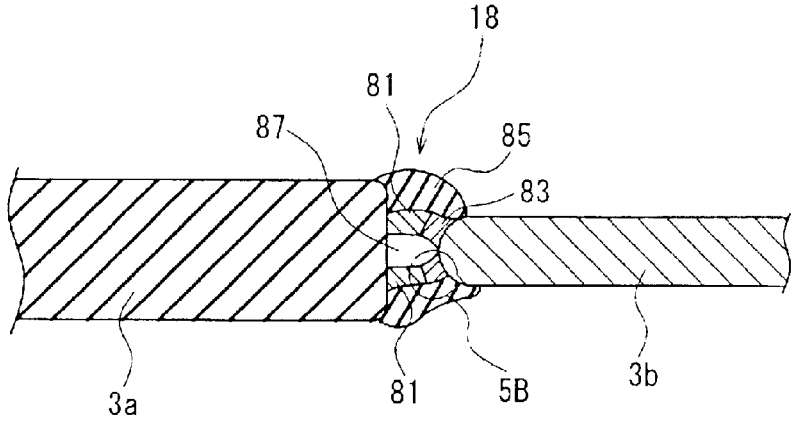
FIG. 5B
PRIOR ART
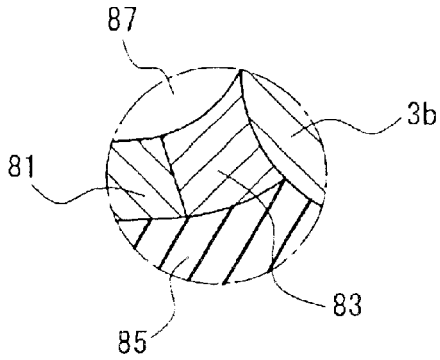

ELECTRODE, MANUFACTURING METHOD THEREOF, AND METAL VAPOR DISCHARGE LAMP

BACKGROUND OF THE INVENTION

1. Field of the Invention

The present invention relates to an electrode suitable for use in a light-emitting tube of a metal vapor discharge lamp, and to a method for manufacturing the same. Furthermore, the present invention also relates to a metal vapor discharge lamp.

2. Related Background Art

Recently, metal vapor discharge lamps have been developed that employ ceramic light-emitting tubes with superior heat resistance so as to achieve high color rendering properties and energy efficiencies, which increases the complexity of the manufacturing process.

The following will describe a conventional method for manufacturing electrodes for use in discharge lamps.

FIG. 9 is a schematic side cross-sectional view for explaining a configuration of a conventional method for manufacturing an electrode, in which two rod-type electrode parts are welded. In FIG. 9, 3*a* and 3*b* denote rod-type electrode parts to be welded, and 20*a* and 20*b* denote a pair of electrodes of a resistance welding machine. The electrode parts 3*a* and 3*b* are supported by the pair of electrodes 20*a* and 20*b* so as to be aligned with each other with the ends of the electrode parts 3*a* and 3*b* brought into contact. Forces F0 in upset welding are applied in directions so as to press the electrode parts 3*a* and 3*b* against each other via the pair of electrodes 20*a* and 20*b*, and current is caused to run through the electrode parts 3*a* and 3*b* via the electrode 20*a* and 20*b*. A heat generated by a resistance at an interface between the contact ends of the electrode parts 3*a* and 3*b* melts the contact ends, thereby bonding the same. Here, a high-purity argon gas is blown to the contact ends of the electrode parts 3*a* and 3*b* at all times.

Such a resistance welding method is effective in the case where both the electrode parts 3*a* and 3*b* are made of metals, but the method has a drawback in that the bonding is not achieved surely in the case where at least one of the electrode parts is made not of a metal but of a cermet. Since a cermet is a material obtained by sintering alumina and a metal, it has properties both of a ceramic and a metal. Therefore, it is difficult to melt the interface portions surely so as to bond the same, with only the aforementioned instantaneous heating by the resistance welding.

Furthermore, apart from the aforementioned resistance welding method, a method has been proposed in which the electrode parts 3*a* and 3*b* are supported with each other with their ends brought into contact, and in this state, the contact ends are irradiated with a laser beam such as a $CO_2$ laser or a YAG laser. However, in the case of such a welding method with a laser beam, since the laser beam has a cross section of an approximately round shape, the projection of the laser beam on the contact ends causes heating irregularities to be generated in a circumferential direction. Hence, it is difficult to bond the border faces surely. Furthermore, since portions of the electrode parts other than the contact ends in a lengthwise direction of the electrode parts are heated as well, in the case where materials of the electrode parts contain tungsten, tungsten becomes brittle, which makes it impossible to secure a strength as an electrode.

SUMMARY OF THE INVENTION

The present invention is intended to solve the foregoing problems of the prior art, and it is an object of the present invention to provide an electrode manufacturing method that allows two electrode parts having different melting points, like those made of a metal and a cermet, to be bonded surely. Furthermore, another object of the present invention is to provide a discharge lamp employing an electrode manufactured by the foregoing manufacturing method. Furthermore, still another object of the present invention is to provide an electrode having a sufficient bonding strength, and a discharge lamp employing the electrode.

To achieve the foregoing object, an electrode manufacturing method of the present invention is a method for manufacturing an electrode by bringing an end of a first electrode part that is in a rod shape into contact with an end of a second electrode part that is in a rod shape and has a melting point higher than that of the first electrode part, and welding the same. The method includes the steps of arranging the first electrode part and the second electrode part on an upper side and on a lower side, respectively, with their lengthwise directions being aligned vertically and lineally, so that ends of the first and second electrode parts are brought into contact and pressed against each other, and subsequently welding the electrode parts by irradiating contact ends of the electrode parts or vicinities thereof with a laser beam. In this method, the laser beam has a cross section in a long narrow shape having a minor axis directed in a vertical direction and a major axis directed in a horizontal direction.

Furthermore, an electrode of the present invention includes a first electrode part that is in a rod shape and a second electrode part that is in a rod shape and has a smaller diameter than that of the first electrode part, with the first and second electrode parts being welded and integrated with each other in a state in which ends thereof are brought into contact. In the electrode, the first electrode part is made of a conductive cermet, the second electrode part is made of tungsten, and in a welded portion where the first and second electrode parts are welded, an alloy layer comprising molybdenum composing the conductive cermet of the first electrode part and tungsten of the second electrode part covers an end of the second electrode part.

BRIEF DESCRIPTION OF THE DRAWINGS

FIG. 4 is a schematic cross-sectional view of a welded portion of the electrode obtained by the welding according to Example 1 of the first embodiment of the present invention.

FIG. 5A is a schematic cross-sectional view of a welded portion of an electrode welded by a conventional resistance welding method, and FIG. 5B is an enlarged cross-sectional view of a part 5B in FIG. 5A.

DETAILED DESCRIPTION OF THE INVENTION

Figure 1A:
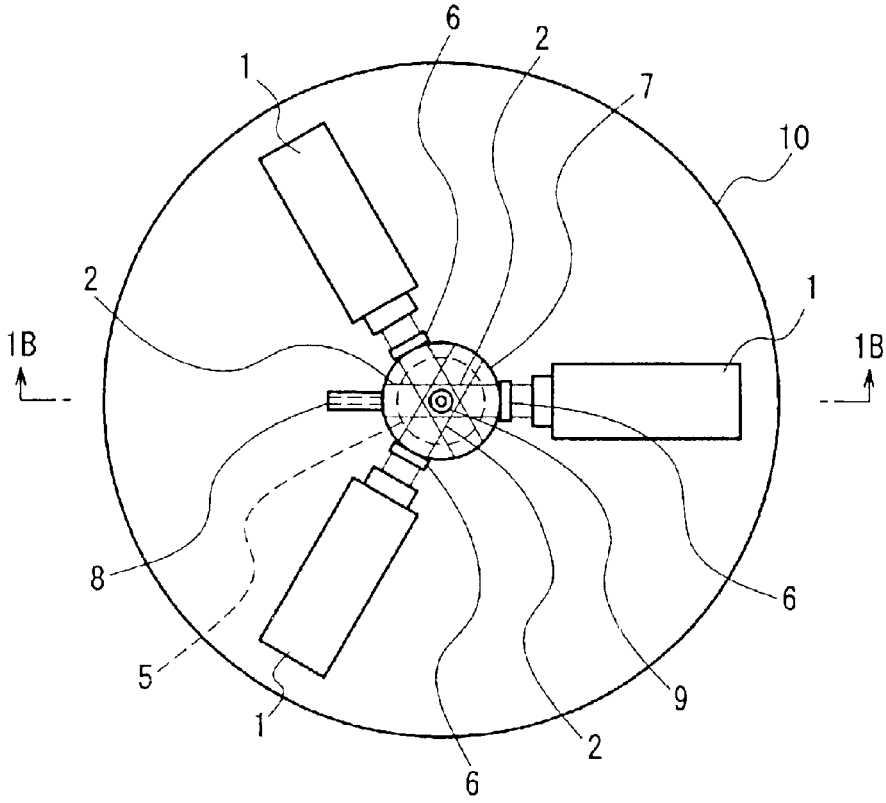
FIG. 1A is a top view illustrating a schematic configuration of a device used in an electrode manufacturing method according to a first embodiment of the present invention.

As described above, in the electrode manufacturing method according to the present invention, the first electrode part is placed on an upper side, and the second electrode part having a melting point higher than that of the first electrode part is placed on a lower side, with their lengthwise directions being aligned vertically and lineally, so that ends of the first and second electrode parts are brought into contact and pressed against each other. Subsequently, the electrode parts are welded by irradiating contact ends of the electrode parts or vicinities thereof with a laser beam.

By heating the contact ends of the electrode parts by the irradiation with the laser beam, the temperature control of the contact ends is facilitated, and unlike the instantaneous heating as in the case of the conventional resistance heating, it is possible to introduce a process as to temperature, such as pre-heating, welding, and cooling. Therefore, even in the case where at least one of the electrode parts is made of a cermet obtained by sintering alumina and a metal and hence having both the properties of a ceramic and a metal, it is possible to melt interface portions surely, thereby achieving stable and secured bonding. As a result, it is possible to reduce welding defects and to stabilize and improve the quality and the yield.

Furthermore, members for supporting the electrode parts and causing current to run through the electrode parts (electrodes 20*a* and 20*b* in FIG. 9), which are required in the conventional resistance heating, are unnecessary. In other words, since the heating of the electrode parts is carried out without contacting the electrode parts, a problem of abrasion occurring to electrodes for welding (electrodes 20*a* and 20*b* in FIG. 9) in a conventional resistance welding device does not occur. Hence, frequent maintenance is unnecessary.

The laser beam has a cross section in a long narrow shape having a minor axis directed in a vertical direction and a major axis directed in a horizontal direction. Therefore, it is possible to project the laser beam to a region wide in an electrode part circumferential direction and narrow in a lengthwise direction at the contact ends or the vicinities thereof. Therefore, it is possible to reduce temperature irregularities in the circumferential direction, and to heat only the contact ends efficiently. Furthermore, in the case where not less than two laser projecting units are used, it is possible to irradiate the whole circumferential region of the contact ends or the vicinities thereof with a smaller number of laser projecting units.

Furthermore, since the first and second electrode parts are aligned vertically so that the first electrode part having a lower melting point is placed on the upper side, the molten material of the first electrode part moves downward and covers the circumferential region of the second electrode part, thereby forming the bonded portion. As a result, the bonding strength is made more uniform in the circumferential direction, and is improved.

In the foregoing method, the first electrode part preferably has a cross-sectional area greater than that of the second electrode part. For instance, the first and second electrode parts preferably are both in a cylindrical shape each, and the first electrode part has a diameter greater than that of the second electrode part. This allows the molten material of the first electrode part to cover the circumferential region of the second electrode part easily, thereby further making the bonding strength in the circumferential direction more uniform.

Furthermore, it is preferable that the first electrode part is made of a conductive cermet, and the second electrode part is made of tungsten. This allows the present invention to be applied to the manufacture of a power feeder for use in a conventional common metal vapor discharge lamp.

Furthermore, a position irradiated with the laser beam preferably is lower than a plane of contact of the electrode parts. More specifically, a position irradiated with the laser beam is lower than a plane of contact of the electrode parts by 0.3 mm to 1.0 mm. This causes the second electrode part that is placed on the lower side and that has a higher melting point to be heated first, and the heat is transmitted to the first electrode part, causing the first electrode part to start melting. Therefore, as compared with the case where the laser beam is projected to the first electrode part having a lower melting point, the second electrode part having a higher melting point is heated to a higher temperature also. This forms a secured bonding face, and improves the bonding strength.

Furthermore, a coil may be wound around at least an end of the second electrode part on a side opposite to the contact end thereof. Here, the coil may be wound around the second electrode part so as to reach the contact end of the second electrode part or a vicinity of the same.

Furthermore, a plurality of laser beams preferably are projected simultaneously from different directions in a horizontal plane to the contact ends or the vicinities thereof. By irradiating the contact ends of the electrode parts or the vicinities thereof with a plurality of laser beams in different angles simultaneously, it is possible to heat the contact ends substantially uniformly throughout the circumferential region thereof within a short time, without rotating the electrode parts, or the like. Therefore, this facilitates the temperature control of the contact ends and improves the operation efficiency.

Furthermore, it is preferable that a plurality of laser projecting units are used for emitting the plurality of laser beams, and the laser projecting units are arranged around the contact ends in a manner such that the plurality of laser beams emitted from the laser projecting units do not irradiate laser-emitting sections of the other laser projecting units. By arranging the laser projecting units so that the laser beams emitted from the laser projecting units do not irradiate laser-emitting sections of the other laser projecting units, it is possible to avoid damage to the laser projecting units. For this purpose, not an even number but an odd number of the laser projecting units preferably is provided. This allows a plurality of laser projecting units to be arranged around the contact ends at constant angle intervals without causing some laser beams to irradiate laser-emitting sections of other laser projecting units, and hence, it is possible to heat the contact ends efficiently and uniformly in the circumferential direction.

Furthermore, the electrode parts brought into contact with each other may be rotated during the irradiation by the laser beam. This allows the number of the laser projecting units to decrease, while allowing the whole circumferential region of the contact ends to be irradiated substantially simultaneously.

Furthermore, an inert gas atmosphere preferably is maintained as an atmosphere around the contact ends during the irradiation by the laser beam. This prevents the oxidation of the bonded portion.

Furthermore, it is preferable that the first and second electrode parts are arranged in a chamber in which an inert gas atmosphere is maintained, and the laser beam is projected from the outside of the chamber. By projecting the laser beam from the outside of the chamber, it is possible to place the laser projecting unit outside the chamber, which allows the capacity of the chamber to decrease. This decreases the usage of the inert gas, thereby reducing the cost.

Furthermore, a force with which the first and second electrode parts are brought into contact and pressed against each other preferably is in a range of 5 N to 20 N. If the force is smaller than that, it is difficult to form an excellent welded portion. On the other hand, if the force is greater than that, there is a possibility that an effect of improving the welded portion decreases, and moreover, a problem such as buckling of the electrode possibly occurs.

Furthermore, in the step of arranging the first and second electrode parts, a position of the second electrode part in a horizontal plane preferably is determined by applying a pressing force in a range of 0.7±0.2 N in a horizontal direction to the second electrode part. If the pressing force is smaller than that, there is a possibility that the electrode parts are welded in a state in which their central axes are deviated from each other. Furthermore, if the pressing force is greater than that, the pressing force that presses the electrode parts against each other decreases, and there is a possibility that an excellent welded portion cannot be obtained.

Furthermore, a metal vapor discharge lamp of the present invention includes an electrode obtained by the electrode manufacturing method according to the aforementioned manufacturing method of the present invention. This makes it possible to provide a stable and long-life discharge lamp.

Furthermore, an electrode of the present invention includes a first electrode part that is in a rod shape and a second electrode part that is in a rode shape and has a smaller diameter than that of the first electrode part, the first and second electrode parts being welded and integrated with each other in a state in which ends thereof are brought into contact. In the electrode, the first electrode part is made of a conductive cermet, the second electrode part is made of tungsten, and in a welded portion where the first and second electrode parts are welded, an alloy layer comprising molybdenum composing the conductive cermet of the first electrode part and tungsten of the second electrode part covers an end of the second electrode part. This improves the welding strength of the welded portion, and variation of the strength decreases.

In the foregoing electrode, alumina composing the conductive cermet of the first electrode part preferably segregates to an outer region in a vicinity of the welded portion. With this, the alumina layer further improves a mechanical strength of the welded portion.

Furthermore, a metal vapor discharge lamp of the present invention includes a light-emitting tube including a main tube having a discharge space, narrow tubes connected to both ends of the main tube, and power feeders inserted into the narrow tubes. In the metal vapor discharge lamp, each of the power feeders is the electrode according to the present invention, and the electrode is inserted into each of the narrow tubes in a state in which the second electrode part is arranged on the main tube side. This makes it possible to provide a metal vapor discharge lamp with a stable quality.

The following will describe embodiments of the present invention in detail, while referring to the drawings.

Figure 7:
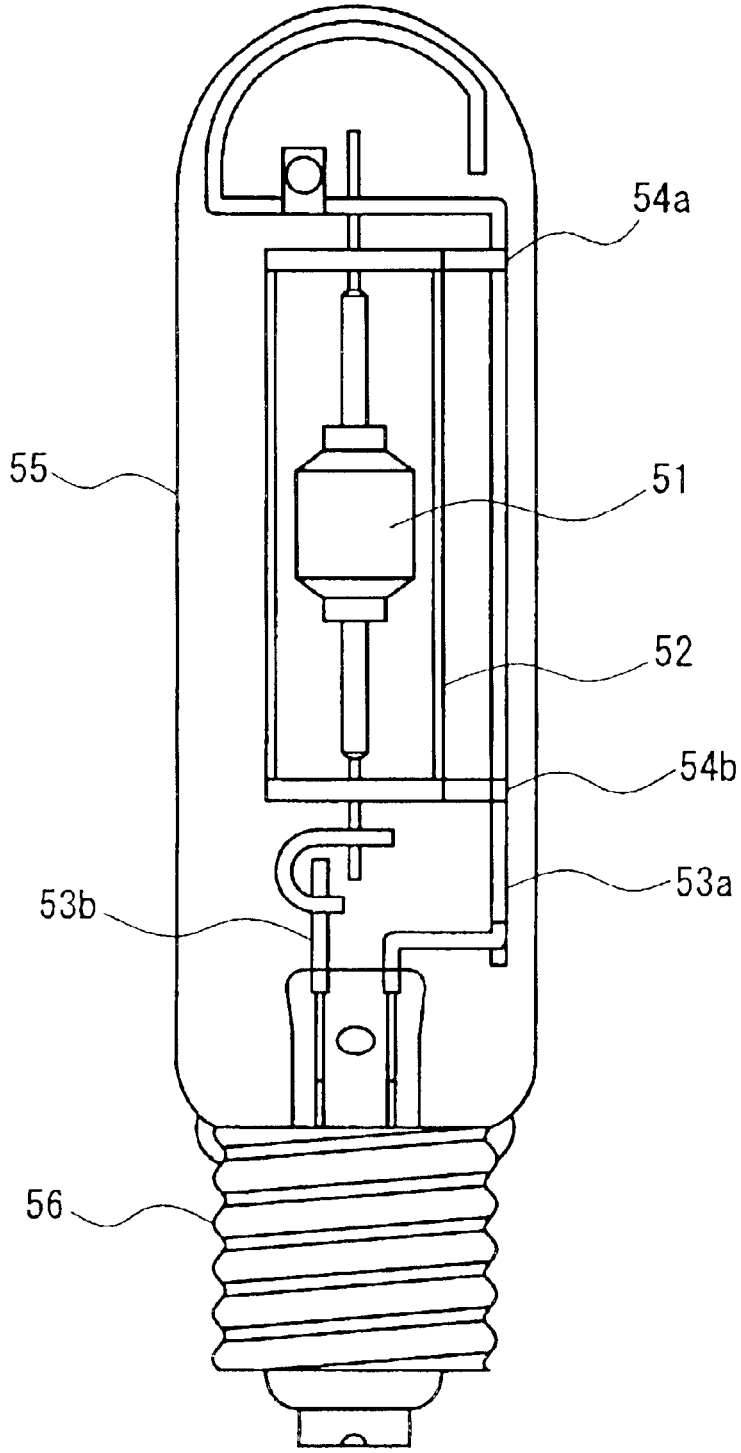
FIG. 7 is a front view illustrating an example of a metal vapor discharge lamp of the present invention.

FIG. 7 is a front view illustrating an example of a metal vapor discharge lamp. As shown in FIG. 7, a light-emitting tube 51, for example, made of alumina ceramic, is supported at a predetermined position in an outer tube 55 by power-supply conductors 53*a* and 53*b*. Nitrogen is sealed in the outer tube 55 at a predetermined pressure, and a base 56 is attached in the vicinity of a sealing section.

The light-emitting tube 51 may be arranged inside a quartz glass sleeve 52, which has an effect of blocking ultraviolet rays. The sleeve 52 provides thermal insulation for the light-emitting tube 51, and maintains a sufficient vapor pressure, as well as performs a function in preventing the outer tube 55 from becoming broken when the light-emitting tube 51 is damaged. The sleeve 52 is supported by the power-supply conductors 53*a* via sleeve supporting plates 54*a* and 54*b*.

Figure 8:
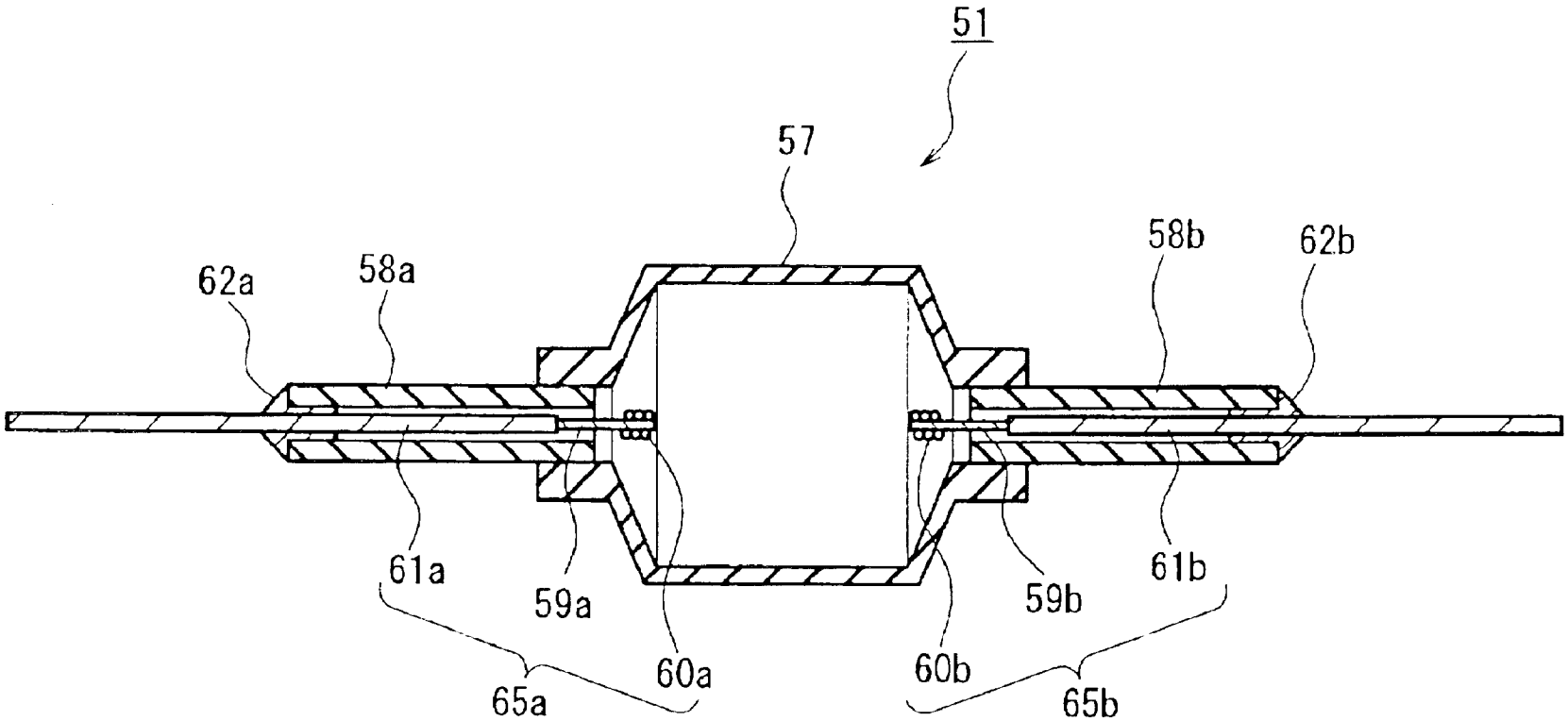
FIG. 8 is a cross-sectional view illustrating a configuration of a light-emitting tube attached to the metal vapor discharge lamp shown in FIG. 7.

FIG. 8 is a cross-sectional view illustrating a configuration of the light-emitting tube 51. As shown in FIG. 8, narrow tubes 58*a* and 58*b* are connected to ends of a main tube (light-emitting unit) 57 forming a discharge space. In the discharge space in the main tube 57, mercury, a rare gas, and a light-emitting metal are sealed.

In the narrow tubes 58*a* and 58*b*, power feeders 65*a* and 65*b* are inserted, respectively, which are composed of coils 60*a* and 60*b*, electrode pins 59*a* and 59*b*, and electrode supporters 61*a* and 61*b*, respectively.

The electrode supporters 61*a* and 61*b* are sealed and fit in the narrow tubes 58*a* and 58*b* by glass frit seals (sealing members) 62*a* and 62*b*, respectively. The glass frit seals 62*a* and 62*b* may be made of a metal oxide, alumina, silica, etc.

The coils 60*a* and 60*b* are made of tungsten, and are wound around ends of the electrode pins 59*a* and 59*b*, respectively, and are arranged in a manner such that they are opposed to each other in the discharge space of the main tube 57. The electrode pins 59*a* and 59*b* are made of a metal such as tungsten. The electrode supporters 61*a* and 61*b* are made of a conductive cermet. The conductive cermet is, for instance, a substance obtained by mixing powder of a metal such as molybdenum and alumina powder and sintering the mixture, and has a thermal expansion coefficient substantially equal to that of alumina.

The present invention provides a method for manufacturing an electrode, which method is used suitably for manufacturing power feeders (electrodes) 65*a* and 65*b* of the aforementioned discharge lamp by bonding by welding the rod-type electrode supporters (first electrode parts) 61*a* and 61*b* with the rod-type electrode pins (second electrode parts) 59*a* and 59*b* having a higher melting point then that of the electrode supporters 61*a* and 61*b*, respectively. Furthermore, the present invention provides electrodes applicable as the power feeders 65*a* and 65 that are obtained by bonding the rod-type electrode supporters 61*a* and 61*b* with the rod-type electrode pins 59*a* and 59*b*, respectively.

First Embodiment

Figure 1B:
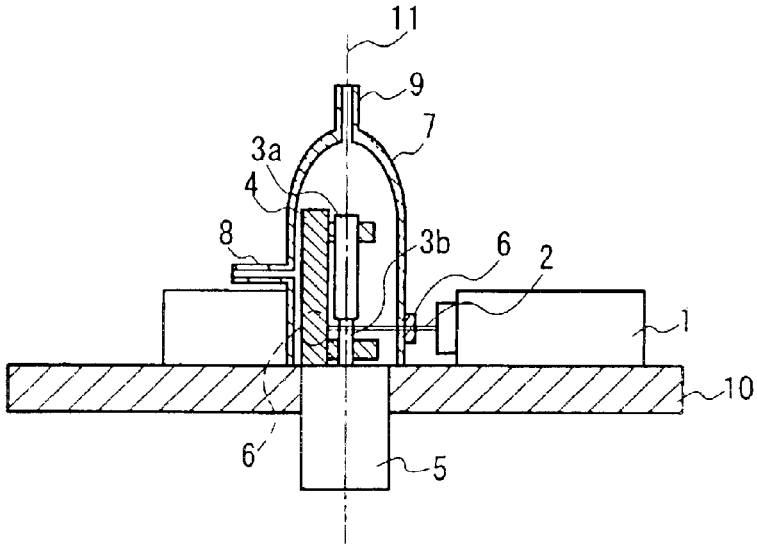
FIG. 1B is a cross-sectional view of the device taken along a line 1B—1B in FIG. 1A, viewed in a direction indicated by arrows.

FIG. 1A is a top view illustrating a schematic configuration of a device used in an electrode manufacturing method according to a first embodiment of the present invention, and FIG. 1B is a cross-sectional view taken along a line 1B—1B in FIG. 1A, viewed in a direction indicated by arrows.

In FIGS. 1A and 1B, 1 denotes a laser projecting unit. 2 denotes a laser beam projected by the laser projecting unit 1. 3*a* and 3*b* denote first and second electrode parts to be welded, respectively. 4 denotes a supporting unit for supporting the first and second electrode parts 3*a* and 3*b*. The supporting unit 4 supports the first and second electrode parts 3*a* and 3*b* in a state in which the first and second electrode parts 3*a* and 3*b* are arranged with their ends brought into contact, so that their axes are aligned lineally with a good precision to have no deviation from each other. 5 denotes a vertical adjustment mechanism for vertically moving the supporting unit 4 that supports the first and second electrode parts 3*a* and 3*b* so that the contact ends of the first and second electrode parts 3*a* and 3*b* are adjusted to substantially the same position in height as those of the laser beams 2 from the laser projecting units 1. 7 denotes a bell jar that provides an inert-gas-filled environment in the vicinity of the first and second electrodes 3*a* and 3*b*. 6 denotes a glass window that allows the laser beam 2 from the laser projecting unit 1 disposed outside the bell jar 7 to enter the inside of the bell jar 7. 8 denotes an inlet provided in the bell jar 7 for introducing an inert gas. 9 denotes an outlet provided in the bell jar 7 for evacuating the inert gas, so that the inert gas is evacuated through the outlet 9 to the outside of the bell jar 7, along with a metal vapor generated in welding. 10 denotes a stage on which the laser projecting units 1, the supporting unit 4, and the bell jar 7 are fixed.

The following will describe an electrode manufacturing method according to the first embodiment employing the device configured as described above.

First, the first and second electrode parts 3*a* and 3*b* to be welded are supported by the supporting unit 4 in a state in which the first and second electrode parts 3*a* and 3*b* are arranged vertically so that their axes are aligned lineally, with their ends brought into contact. Here, the first electrode part 3*a* having a relatively lower melting point (for instance, the electrode supporter 61*a* or 61*b*) may be arranged on an upper side, while the second electrode part 3*b* having a relatively higher melting point (for instance, the electrode pin 59*a* or 59*b*) may be arranged on a lower side.

Figure 2A:
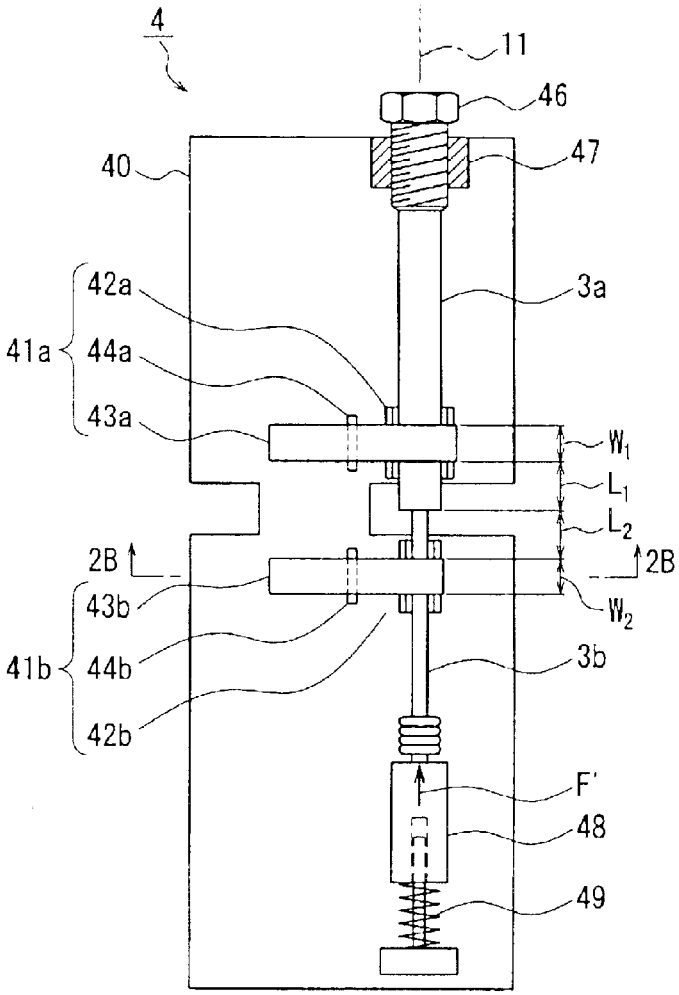
FIG. 2A is a partially-cross-sectional front view illustrating a schematic configuration of a supporting unit of the device shown in FIG. 1A.
Figure 2B:
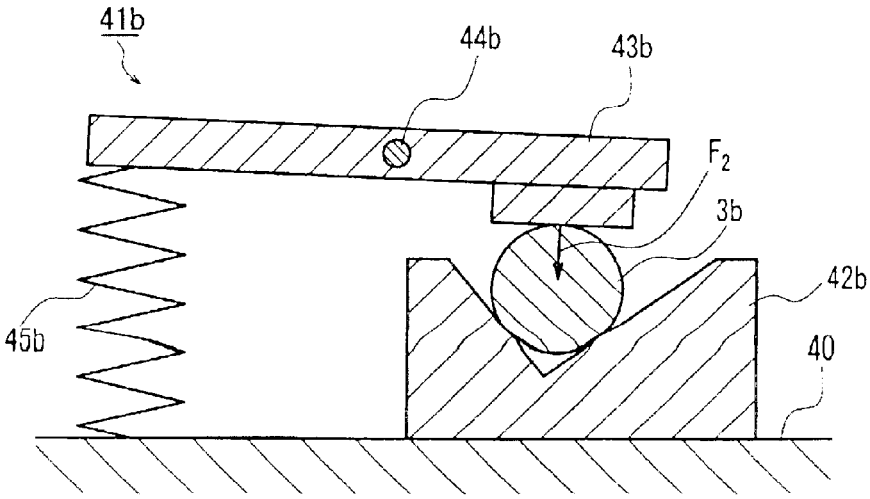
FIG. 2B is a cross-sectional view of the unit taken along a line 2B—2B in FIG. 2A, viewed in a direction indicated by arrows.

FIG. 2A illustrates a schematic configuration of the supporting unit 4. FIG. 2B is a cross-sectional view taken along a line 2B—2B in FIG. 2A, viewed in a direction indicated by arrows. Provided on a base 40 are a first supporting mechanism 41*a* and a second supporting mechanism 41*b* for supporting the first electrode part 3*a* and the second electrode part 3*b*, respectively. As shown in FIG. 2B, the second supporting mechanism 41*b* includes a V-notched block 42*b* having a V-shape groove, a pressing plate 43*b* that is supported so as to be swingable on a shaft 44*b* as a fulcrum, and a compression coil spring 45*b* for applying an energizing force to one end of the pressing plate 43*b*. The second electrode part 3*b* is in contact with the V-shape groove of the V-notched block 42*b*, and is positioned at a predetermined position in a horizontal plane (plane parallel with a face of the sheet carrying FIG. 2B) by a pressing force F2 applied by the other end of the pressing plate 43*b*. As in the case of the second supporting mechanism 41*b* shown in FIG. 2B, the first supporting mechanism 41*a* likewise includes a V-notched block 42*a* having a V-shape groove, a pressing plate 43*a* that is supported so as to be swingable on a shaft 44*a* as a fulcrum, and a compression coil spring (not shown) for applying an energizing force to the pressing plate 43*a*, wherein the first electrode part 3*a* is positioned at a predetermined position in the horizontal plane. In FIG. 2A, 46 denotes a bolt having a male screw, and 47 denotes a threaded female member provided on the base 40, in which the bolt 46 is engaged. By bringing an upper end of the first electrode part 3*a* into contact with a lower end of the bolt 46, the position of the first electrode part 3*a* is determined with respect to the supporting unit 4 in a direction of an axis 11 (central axis passing through an opening of the stage 10 in a vertical direction: see FIG. 1B). 48 denotes a sliding member that is supported so as to be slidable in the axis 11 direction. 49 denotes a compression coil spring that energizes the sliding member 48 in an upward direction as viewed in FIG. 2A. With the energizing force F' of the compression coil spring 49 exerted against the second electrode part 3*b* via the sliding member 49, the first and second electrode parts 3*a* and 3*b* are brought into contact with each other so that they are pressed against each other with a predetermined pressing force. Examples of specific numerical values follow. In FIG. 2A, respective dimensions W1 and W2 of the pressing plates 43*a* and 43*b* in the axis 11 direction are 4 mm each, and a length L1 of a projecting portion of the first electrode part 3*a* from the pressing plate 43*a* and a length L2 of a projecting portion of the second electrode part 3*b* from the pressing plate 43*b* are 4 mm each. Furthermore, in FIG. 2B, a pressing force F2 applied by the pressing plate 43*b* to the second electrode part 3*b* preferably is 0.7±0.2 N, or more preferably, 0.7±0.1 N. If the pressing force F2 is smaller than 0.5 N, the positioning accuracy of the second electrode part 3*b* in the horizontal plane is lowered, thereby making it difficult to weld the first and second electrode parts 3*a* and 3*b* with their central axes being aligned lineally. Further, if the pressing force F2 exceeds 0.9 N, the pressing force with which the first and second electrode parts 3*a* and 3*b* are pressed against each other is decreased, thereby making it difficult to obtain an excellent welded portion as described later. It should be noted the foregoing numerical values are merely examples, and they may be varied appropriately according to the dimensions of the first and second electrode parts 3*a* and 3*b* used, or the like.

Figure 3C:
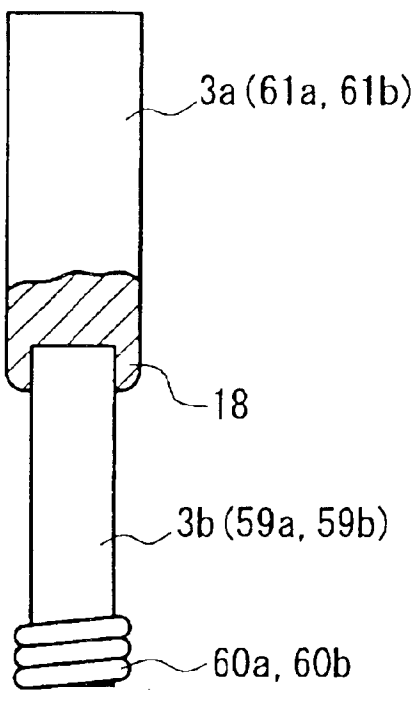
FIGS. 3A to 3C are side views illustrating a manufacturing method according to the first embodiment of the present invention step by step.
Figure 3B:
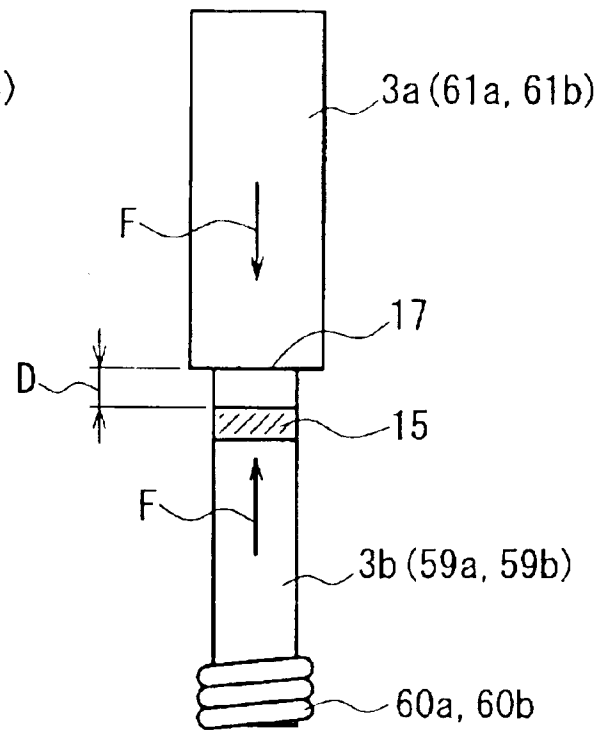
Figure 3A:
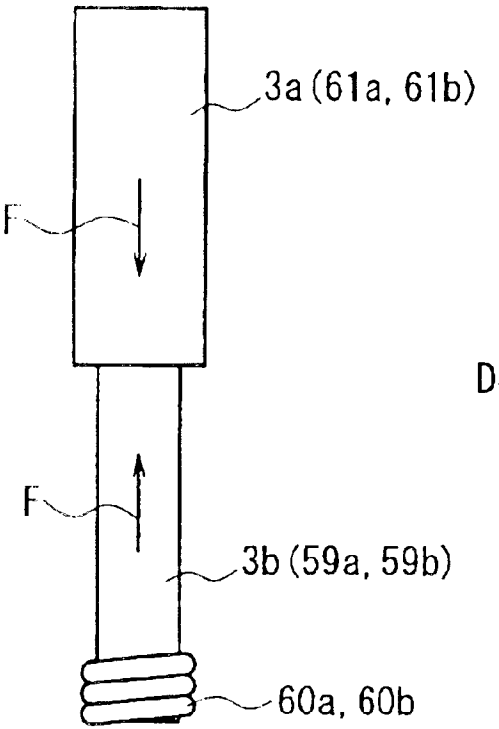

FIG. 3A is a side view illustrating the first and second electrode parts 3*a* and 3*b* supported with their ends being in contact with each other. Here, the aforementioned energizing force F' of the compression coil spring 49 generates forces F that are applied to the first and second electrode parts 3*a* and 3*b* to press them against each other. The force F preferably is 5 N to 20 N.

As shown in FIGS. 1A and 1B, the supporting unit 4 is mounted on the vertical adjustment mechanism 5. The vertical adjustment mechanism 5 on which the electrode parts 3*a* and 3*b* are fixed via the supporting unit 4 is attached to the stage 10 so as to be inserted from below into the opening at the center of the stage 10 on which the three laser projecting units 1 and the bell jar 7 are mounted. The three laser projecting units 1 are arranged radially around the center axis 11 at angle intervals of 120° each, so that laser beams 2 emitted from the laser projecting units 1 cross each other at one point on the central axis 11 that extends in the vertical direction through the opening of the stage 10. The central axes of the first and second electrode parts 3*a* and 3*b* substantially coincide with the central axis 11 of the stage 10. The position in the central axis 11 direction of the electrode parts 3*a* and 3*b* supported by the supporting unit 4 is determined by the vertical adjustment mechanism 5 so that the position (height) in the central axis 11 direction of the contact ends of the first and second electrode parts 3*a* and 3*b* substantially coincides with that of the crossing point of the laser beams emitted from the three laser projecting units 1. The vertical adjustment mechanism 5 may be any raising and lowering mechanism; for instance, a moving mechanism composed of a motor and a feed screw may be used.

Next, an inert gas (for instance, Ar) is introduced into the bell jar 7 through the inert gas inlet 8 so that the inert gas fills the inside of the bell jar 7. Here, the oxygen concentration inside the bell jar 7 preferably is not more than 200 ppm.

After filling the gas, the laser beams 2 from the three laser projecting units 1 are projected simultaneously through the glass windows 2 to the contact ends of the electrode parts 3*a* and 3*b* or their vicinities.

FIG. 3B is a side view illustrating the first and second electrode parts 3*a* and 3*b* irradiated with the laser beams. In the drawing, a hatched region 15 denotes a region irradiated with the laser beams. The position of the region 15 irradiated with the laser beams may coincide with a position of a contact plane 17 at which the first and second electrode parts 3*a* and 3*b* are brought into contact, but it is preferable that the region is positioned slightly below the contact plane 17, as shown in the drawing. More specifically, the region irradiated with the laser beams preferably is positioned at a distance D of 0.3 to 1.0 mm from the contact plane 17.

The vicinities of the contact ends of the electrode parts 3*a* and 3*b* are heated and molten, by adjusting output powers of the laser projecting units 1. The temperature for heating the contact ends is, for instance, 2600° C.±600° C.

Conditions for the irradiation of the laser beams are not limited particularly. However, for instance, in the case where the first and second electrode parts 3*a* and 3*b* with a diameter of approximately 2 mm each (the greater diameter if they have different diameters) are brought into contact and welded, semiconductor laser sources, each having an output power of 300W and a wavelength of 808 nm, are used as the laser projecting units 1, and a laser beam projection time is approximately 10 seconds. In the case where the first and second electrode parts 3*a* and 3*b* with a diameter of approximately 0.5 mm each (the greater diameter if they have different diameters) are brought into contact and welded, semiconductor laser sources, each having an output power of 100W and a wavelength of 808 nm, are used as the laser projecting units 1, and a laser beam projection time is approximately 1 second. Thus, it is preferable to vary the output power of the laser sources and the projection time of the laser beams in proportion to the diameters of the electrode parts 3*a* and 3*b*.

Furthermore, a cross section of each laser beam 2 taken in a direction orthogonally crossing the laser beam traveling direction has a long narrow shape with a minor axis directed in the central axis 11 direction (vertical direction) and a major axis directed in a direction orthogonally crossing the central axis 11 direction (horizontal direction). Here, examples of the "long narrow shape" include a rectangle, an ellipse, etc., as well as a shape such that at least one of two pairs of opposed sides (i.e., a pair of longer sides and/or a pair of shorter sides) of a rectangle are replaced with arcs curving outward or curves approximated to the same. Here, a length WL in the major axis direction of the foregoing long narrow shape preferably is set to be slightly greater (for example, approximately 2 mm greater) than a diameter $\phi$ of the second electrode part 3*b* irradiated with the laser beams. $WL \geqq 1.2\phi$ is more preferable, and $1.2\phi \leqq WL \leqq 2.0\phi$ is particularly preferable. Furthermore, an upper limit of a length WS of the long narrow shape in the minor axis direction preferably is not more than the diameter $\phi$ of the second electrode part 3*b*, and a lower limit of the same preferably is not less than 0.05 mm. Since the beams have long narrow shapes, it is possible to heat only the contact ends efficiently. Furthermore, since the major axis of the long narrow shape extends in a direction orthogonally crossing the central axis 11 direction, in combination with the effect of simultaneous irradiation by the plurality of the laser projecting units 1 arranged radially, this makes it possible to heat substantially the whole circumference of the contact ends of the electrode parts 3*a* and 3*b* uniformly. Therefore, this facilitates the temperature control of the contact ends, and makes a rotation driving unit like that in the second embodiment described later unnecessary. Such a laser beam shape can be achieved by a known method such as a method of employing a lens provided on a laser emitting window of the laser projecting unit 1.

The irradiated region 15 of the second electrode part 3*b* is heated by the irradiation with the laser beam, and the heat thus generated is transmitted to the first electrode portion 3*a* via the contact plane 17. As a result, the first electrode part 3*a* having a relatively lower melting point starts melting. Here, alumina in the cermet as a material of the first electrode part 3*a* moves outward, a part of the same is evaporated, and the remnant is crystallized. Furthermore, molybdenum in the cermet and tungsten as a material of the second electrode part 3*b* form an alloy.

Furthermore, in the foregoing welding process, the pressing force F applied to the first and second electrodes 3*a* and 3*b* causes the second electrode part 3*b* having a smaller diameter to intrude into the first electrode part 3*a* having a greater diameter, which is molten. Moreover, since the first electrode part 3*a* is located on the upper side, the molten material (alumina in particular) of the first electrode part 3*a* in the vicinity of the contact plane 17 is deformed and moves downward. Consequently, a lower end portion of the first electrode part 3*a* is deformed in a convex downward dome shape (hemispherical shape), into which the second electrode part 3*b* is inserted, whereby a welded portion 18 is formed as shown in FIG. 3C. In the welded portion 18, the constituent material of the first electrode part 3*a* substantially uniformly covers a whole circumference of the second electrode part 3*b*. Therefore, the bonding strength is stabilized and improved in the circumferential direction.

After the welding, the vertical adjustment mechanism 5 is removed from the stage 10, and the first and second electrode parts 3*a* and 3*b* welded and integrated are taken out of the supporting unit 4. Thus, a welded electrode (electric feeder) is obtained.

EXAMPLE 1

The following will describe a specific example corresponding to the first embodiment.

A rod-type part made of a conductive cermet composed of 50% alumina and 50% molybdenum (mass ratio), with a diameter of 1.2 mm and a length of 8.25 mm was used as the first electrode part 3*a*. A rode-type part made of tungsten, with a diameter of 0.71 mm and a length of 22.3 mm was used as the second electrode part 3*b*.

A semiconductor laser (wavelength: 800 nm, output power: 130 W) was used as the laser projecting unit 1. Three of the semiconductor lasers were arranged radially around the central axis 11 at angular intervals of 120° on a horizontal plane. Laser beams 2, each having a cross section in a rectangular shape (WL: 3 mm×WS: 0.5 mm), were projected from the laser projecting units 1 to a position on the second electrode part 3*b*, the position being at a distance D=0.5 mm downward from a contact plane 17 where the first electrode part 3*a* and the second electrode part 3*b* were brought into contact. A time for projecting the laser beams was set to be 1.3 seconds.

FIG. 4 schematically illustrates a cross section of a welded portion 18 of the obtained electrode. In FIG. 4, 81 denotes a Mo (molybdenum) layer, 83 denotes a Mo—W (molybdenum-tungsten) alloy layer, and 85 denotes an alumina layer. These are considered to have been generated as follows. The second electrode part 3*b* was heated by the irradiation with the laser beams, and the heat was transmitted to the first electrode part 3*a*. Consequently, the first electrode part 3*a* was molten, and the cermet was dissolved into alumina and molybdenum. Alumina was diffused locally, and segregated to an outer region of the welded portion 18, thereby forming an alumina layer 85. On the other hand, molybdenum segregated to the center of the welded portion, thereby forming a molybdenum layer 81. At the same time, the molybdenum was combined with tungsten of the second electrode part 3*b*, thereby forming a Mo—W alloy layer 83 on a bonding interface with the second electrode part 3*b*, over an end face of the second electrode part 3*b*. By irradiating the portion of the second electrode part 3*b* in the vicinity of the contact end thereof with the laser beams 2 having long narrow cross sections from three directions, heating irregularities in the circumferential direction were decreased. Therefore, the Mo—W alloy layer 83 and the alumina layer 85 were formed so as to be substantially symmetric with respect to the central axis 11 (see FIG. 1). Furthermore, since it was heated within a short time, it was possible to suppress the formation of the alumina layer 85. As a result, it was possible to suppress an increase in the outer diameter of the welded portion 18, thereby achieving dimensional accuracy for the electrode (dimensional accuracy for the outer diameter in the present example: 1.2 mm±0.2 mm). Furthermore, the variation of characteristics of the welded portion 18 among electrodes was small.

Figure 9:
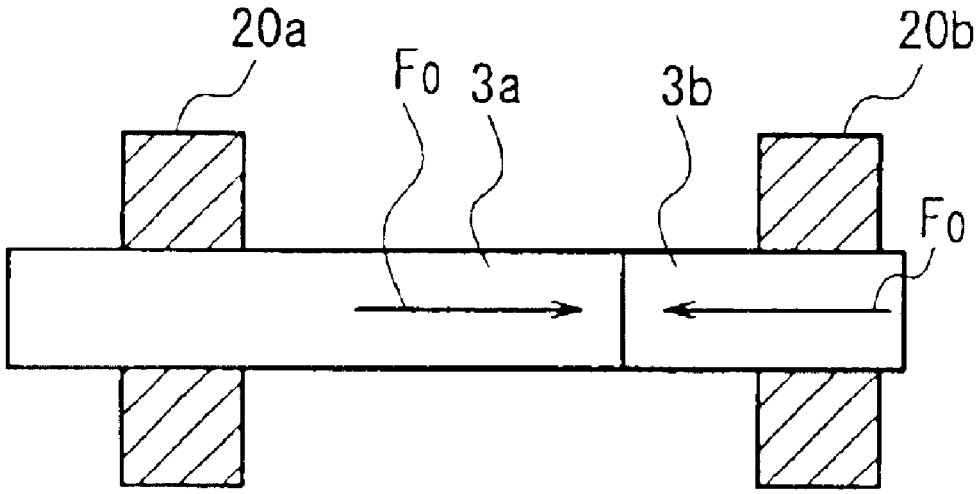
FIG. 9 PRIOR ART
FIG. 9 is a cross-sectional view schematically illustrating a conventional electrode manufacturing method.

As a comparative example, the same first and second electrode parts 3*a* and 3*b* as those in the foregoing example were welded by a conventional resistance welding method shown in FIG. 9. FIG. 5A schematically illustrates a cross section of a welded portion 18, and FIG. 5B is an enlarged view of a part 5B in FIG. 5A. In the present comparative example, a void 87 occurred at the center, and a molybdenum layer 81 and a Mo—W alloy layer 83 were formed surrounding the void 87, the Mo—W alloy layer 83 being formed with molybdenum segregated from the first electrode part 3*a* and tungsten of the second electrode part 3*b*. More specifically, it was found that the Mo—W alloy layer 83 did not extend throughout an end face of the first electrode part 3*a* as in the foregoing example, but the first electrode part 3*a* and the second electrode part 3*b* substantially were connected locally with each other in an approximately so-called point-junction state. Furthermore, alumina was segregated from the first electrode part 3*a* thereby forming an alumina layer 85, so as to surround a circumferential region of the welded portion 18 and swell therefrom. This results in an increase in the outer diameter of the welded portion 18, thereby failing to achieve the finished dimensional accuracy (diameter: 1.2±0.2 mm). Furthermore, it was evident that the Mo—W alloy layer 83 and the alumina layer 85 were asymmetric with respect to the central axis.

Mechanical strengths of the welded portions 18 of the electrodes thus obtained in the foregoing present example and comparative example were determined. The method for determination was as follows. The electrode was supported at an end on one side of at the first electrode part 3*a*, and an external force was applied to a side of the second electrode part 3*b* in a direction orthogonally crossing a lengthwise direction of the electrode. By increasing the external force gradually and determining a magnitude of the external force when the welded portion 18 got broken, the mechanical strength of the welded portion 18 was evaluated. As a result, the mechanical strengths of the welded portions 18 of the electrodes obtained according to the present example were within specifications, and variations among the samples were small. In contrast, the mechanical strength of the welded portion 18 of the electrode obtained in the comparative example varied significantly among samples, and an average strength of the comparative example was lower than that of the present example by 0.98 N or more. It is considered that in the present example, the Mo—W alloy metal layer 83 that has a significant influence on the mechanical strength covers an end of the second electrode part 3*b*, thereby improving the welding strength in the welded portion 18, and stabilizing the strength. On the other hand, it is considered that in the comparative example, the Mo—W alloy layer 83 was formed asymmetrically with respect to the central axis on a part of an end face of the second electrode part 3*b*, thereby causing the electrode to be inferior in both the strength and the variation of the strength.

As described above, by using the electrode manufacturing method shown above in conjunction with the present embodiment, it is possible to improve the mechanical strength and the finished dimensional accuracy of the welded portion, and to reduce the variation of the characteristics.

Second Embodiment

Figure 6A:
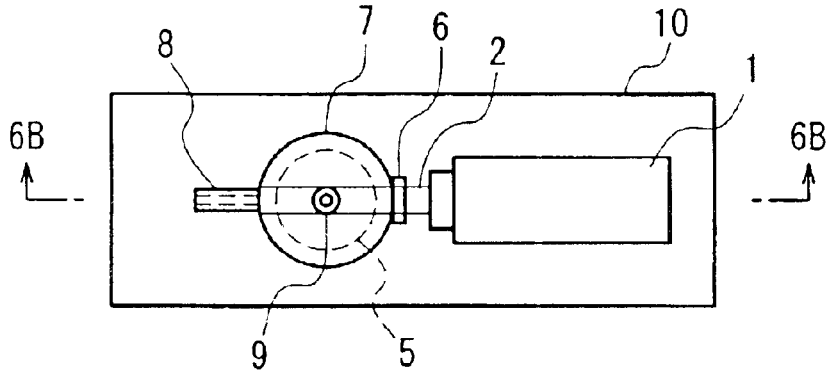
FIG. 6A is a top view illustrating a schematic configuration of a device used in an electrode manufacturing method according to a second embodiment of the present invention.
Figure 6B:
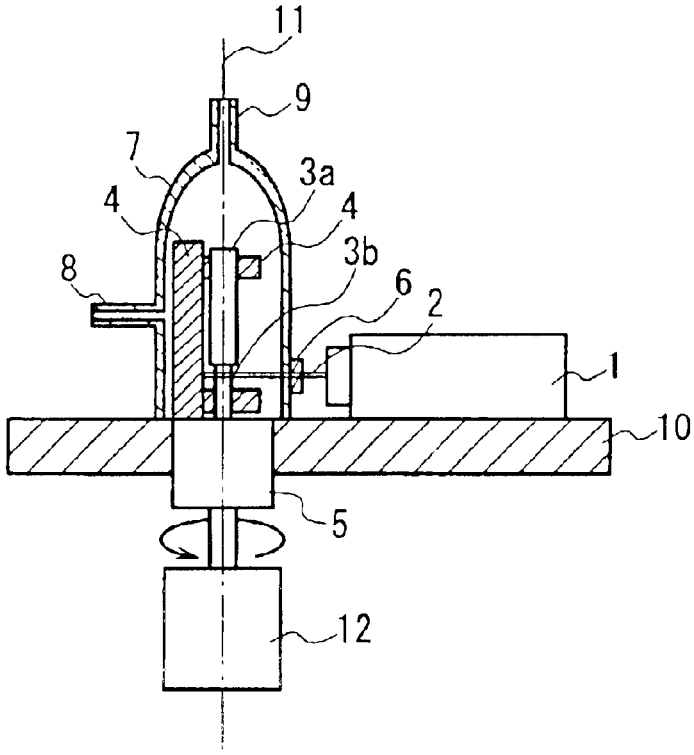
FIG. 6B is a cross-sectional view of the device taken along a line 6B—6B in FIG. 6A, viewed in a direction indicated by arrows.

FIG. 6A is a top view illustrating a schematic configuration of a device used in an electrode manufacturing method according to a second embodiment of the present invention. FIG. 6B is a cross-sectional view taken along a line 6B—6B in FIG. 6A, viewed in a direction indicated by arrows.

In FIGS. 6A and 6B, members having the same functions as those shown in FIGS. 1A and 1B are designated by the same reference numerals, and detailed descriptions thereof are omitted herein.

The device of the second embodiment is different from the device of the first embodiment regarding the following points: only one laser projecting unit 1 is provided; and a driving unit 12 rotates around the central axis 11 the vertical adjustment mechanism 5, upon which is mounted the supporting unit 4 that supports the first and second electrode parts 3*a* and 3*b*.

The following will describe the manufacturing method of the second embodiment in which the device configured as described above is used.

The first and second electrode parts 3*a* and 3*b* are supported by the supporting unit 4 in a state in which the first and second electrode parts 3*a* and 3*b* are aligned vertically in a state of being brought into contact with each other, as in the first embodiment. The vertical adjustment mechanism 5 on which the first and second electrode parts 3*a* and 3*b* are fixed via the supporting unit 4 is attached to the stage 10 so as to be inserted from below into the opening of the stage 10 on which the laser projecting unit 1 and the bell jar 7 are mounted. The laser projecting unit 1 is arranged facing the center axis 11 so that the laser beam 2 emitted therefrom crosses the central axis 11 that passes the opening of the stage 10. The central axes of the first and second electrode parts 3*a* and 3*b* substantially coincide with the central axis 11. The position of the first and second electrode parts 3*a* and 3*b* supported by the supporting unit 4 is determined in the central axis 11 direction by the vertical adjustment mechanism 5 so that the contact ends of the first and second electrode parts 3*a* and 3*b* or the vicinities thereof are irradiated with the laser beam from the laser projecting unit 1.

Next, as in the first embodiment, an inert gas is introduced into the bell jar 7 through the inert gas inlet 8 so that the inert gas fills the inside of the bell jar 7.

After providing the gas, the driving unit 12 is actuated, so as to rotate the vertical adjustment mechanism 5 and the supporting unit 4 that supports the first and second electrode parts 3*a* and 3*b*. The rotation speed may be approximately 50 to 60 rpm. The laser beam 2 from the laser projecting unit 1 is passed through the glass window 6 so as to irradiate the contact ends of the first and second electrode parts 3*a* and 3*b* or the vicinities thereof. Here, as in the first embodiment, a laser-irradiated region preferably is slightly below the contact plane at which the first and second electrode parts 3*a* and 3*b* are brought into contact. The rotation of the supporting unit 4 causes the first and second electrode parts 3*a* and 3*b* to rotate around the central axis 11 as rotation axis, so that a substantially whole circumferential region of the contact ends of the first and second electrode parts 3*a* and 3*b* or the vicinities thereof is irradiated with the laser beam 2. By adjusting the output power of the laser projecting unit 1, the first and second electrode parts 3*a* and 3*b* are bonded with each other in the same manner as that in the first embodiment.

Thereafter, the vertical adjustment mechanism 5 is removed from the stage 10, and the first and second electrode parts 3*a* and 3*b* welded and integrated are taken out of the supporting unit 4. Thus, a welded electrode (electric feeder) is obtained.

EXAMPLE 2

The following will describe a specific example corresponding to the second embodiment.

The same first electrode part 3*a* made of the same conductive cermet and the same second electrode part 3*b* made of tungsten as those used in Example 1 of the first embodiment were used, and were welded by a welding method according to the second embodiment.

A welded portion of the electrode thus obtained was such that the Mo—W alloy metal layer covers an end of the second electrode part 3*b* and an alumina layer covers an end of a circumferential region of the welded portion, which was identical to that shown in FIG. 4 schematically illustrating the welded portion 18 of Example 1. An outer diameter of the welded portion satisfied the dimensional accuracy of the electrode (1.2 mm±0.2 mm). Furthermore, the mechanical strength of the welded portion and the variation thereof were at substantially the same levels as those of the electrode of Example 1.

In the first and second embodiments described above, the coils 60*a* and 60*b* are provided on only one-side ends of electrode pins (second electrode parts) 59*a* and 59*b*, respectively, and only the other-side ends thereof, where the coils 60*a* and 60*b* are not provided, are bonded with the electrode supporters (first electrode parts) 61*a* and 61*b*, respectively. However, the present invention is applicable to a case where the coils 60*a* and 60*b* are provided over the electrode pins 59*a* and 59*b* substantially throughout their whole length, respectively. In this case, at the bonded portions with the electrode supporters 61*a* and 61*b*, not only a material of the electrode pins 59*a* and 59*b* (for instance, tungsten) but also a material of the coils 60*a* and 60*b* (for instance, tungsten) are welded with a material of the electrode supporters 61*a* and 61*b* (for instance, a conductive cermet). Furthermore, in this case, the winding pitch of the coils 60*a* and 60*b* provided over the electrode pins 59*a* and 59*b* substantially throughout the whole lengths are not necessarily uniform, but may be increased on sides of portions welded with the electrode supporters 61*a* and 61*b*.

Though the above-described first and second embodiments are described referring to the cases where the first and second electrode parts 3*a* and 3*b* are solid and cylindrical, the first second electrode parts are not limited to the foregoing examples as long as they are in "rod" shapes. For instance, their cross sections need not be round, but may have various types of polygonal shapes or elliptic shapes. Furthermore, their cross-sectional areas need not be uniform in the lengthwise direction. Besides, they may be hollow.

Furthermore, cases in which the first electrode part 3*a* is made of a conductive cermet and the second electrode part 3*b* is made of tungsten are described as the first and second embodiments, but the materials of the first and second electrode parts 3*a* and 3*b* are not limited to these. The manufacturing methods of the present invention are applicable as long as the material of the second electrode part has a melting point higher than that of the material of the first electrode part.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electrode manufacturing method for manufacturing an electrode by bringing an end of a first electrode part in a rod shape into contact with an end of a second electrode part in a rod shape having a melting point higher than that of the first electrode part, and welding the same, the method comprising the steps of:

arranging the first electrode part and the second electrode part on an upper side and on a lower side, respectively, with their lengthwise directions being aligned vertically and lineally, so that ends of the first and second electrode parts are brought into contact and pressed against each other; and subsequently welding the electrode parts by irradiating contact ends of the electrode parts or vicinities thereof with a laser beam, wherein the laser beam has a cross section in a long narrow shape having a minor axis directed in a vertical direction and a major axis directed in a horizontal direction.

2. The electrode manufacturing method according to claim 1, wherein the first electrode part has a cross-sectional area greater than that of the second electrode part.

3. The electrode manufacturing method according to claim 1, wherein the first electrode part is made of a conductive cermet, and the second electrode part is made of tungsten.

4. The electrode manufacturing method according to claim 1, wherein a position irradiated with the laser beam is lower than a plane of contact of the electrode parts.

5. The electrode manufacturing method according to claim 1, wherein a position irradiated with the laser beam is lower than a plane of contact of the electrode parts by 0.3 mm to 1.0 mm.

6. The electrode manufacturing method according to claim 1, wherein a coil is wound around at least an end of the second electrode part on a side opposite to the contact end thereof.

7. The electrode manufacturing method according to claim 6, wherein the coil is wound around the second electrode part so as to reach the contact end of the second electrode part or a vicinity of the same.

8. The electrode manufacturing method according to claim 1, wherein a plurality of laser beams are projected simultaneously from different directions in a horizontal plane to the contact ends or the vicinities thereof.

9. The electrode manufacturing method according to claim 8, wherein a plurality of laser projecting units are used for emitting the plurality of laser beams, and the laser projecting units are arranged around the contact ends in a manner such that the plurality of laser beams emitted from the laser projecting units do not irradiate laser-emitting sections of the other laser projecting units.

10. The electrode manufacturing method according to claim 1, wherein the electrode parts brought into contact with each other are rotated during the irradiation by the laser beam.

11. The electrode manufacturing method according to claim 1, wherein an inert gas atmosphere is maintained as an atmosphere around the contact ends during the irradiation by the laser beam.

12. The electrode manufacturing method according to claim 1, wherein the first and second electrode parts are arranged in a chamber in which an inert gas atmosphere is maintained, and the laser beam is projected from the outside of the chamber.

13. The electrode manufacturing method according to claim 1, wherein a force with which the first and second electrode parts are pressed against each other is in a range of 5 N to 20 N.

14. The electrode manufacturing method according to claim 1, wherein in the step of arranging the first and second electrode parts, a position of the second electrode part in a horizontal plane is determined by applying a pressing force in a range of 0.7±0.2 N in a horizontal direction to the second electrode part.

* * * * *